United States Patent [19]

Newman

[11] 4,266,352

[45] May 12, 1981

[54] BALLAST SIDE PLOW

[75] Inventor: George R. Newman, West Columbia, S.C.

[73] Assignee: Canron Corporation, West Columbia, S.C.

[21] Appl. No.: 83,945

[22] Filed: Oct. 11, 1979

[51] Int. Cl.[3] ..... E01B 27/04

[52] U.S. Cl. ..... 37/105

[58] Field of Search ..... 37/104, 105, 30, 29, 37/26; 104/5, 7 A, 279

[56] References Cited

U.S. PATENT DOCUMENTS

| | | | |
|---|---|---|---|
| 3,250,027 | 5/1966 | Stein | 37/105 |
| 3,491,467 | 1/1970 | Finger | 37/104 |
| 3,651,587 | 3/1972 | Plasser et al. | 37/105 |
| 3,803,733 | 4/1974 | Ramsey | 37/104 |
| 3,877,160 | 4/1975 | Plasser et al. | 37/104 |

*Primary Examiner*—Richard A. Bertsch

*Attorney, Agent, or Firm*—Wenderoth, Lind & Ponack

[57] ABSTRACT

A railroad ballast plowing machine is provided with a side plow which comprises a pair of plow devices mounted one on each side of the machine in a parallel upright position so that a rectangular main plow board of each plow device extends longitudinally of the track. A first wing is pivotally connected to a leading edge of each plow board and a rear wing is pivotally attached to a trailing edge of each plow board. Each of the first wings includes an inner and an outer flap which is independently rotatable about a substantially vertical hinge line at the leading edge of each plow board. Each of these rear wings includes an inner and outer flap which is independently rotatable about a substantially vertical hinge line at the trailing edge of each plow board. Suitable devices are provided for rotating the flaps. Ballast passing gates are provided in the main plow board adjacent their leading and trailing edges at the bottom of each plow board.

3 Claims, 8 Drawing Figures

BALLAST SIDE PLOW

BACKGROUND OF THE INVENTION

Several railroad ballast centre plow devices are known which move ballast from an edge of the railroad track towards the centre thereof and from the centre outwardly of the track but owing to the shortness of the length of these centre plows it has frequently been required to provide a wing device outside the plow, to increase the range of movement of ballast which the plow can effect. The present invention provides a plow device which is operationally positioned externally of the tie ends and which increases the distance through which the centre plow can move ballast (when used with a centre plow) and which is capable of adopting a variety of configurations to provide a wide range of versatility. Examples of centre plow devices are shown in U.S. Pat. Nos. 3,468,042; 3,605,297; 1,777,588 and 3,019,536. Examples of side plow devices are shown in U.S. Pat. Nos. 3,605,297; 3,468,042; and 3,019,536.

SUMMARY OF THE INVENTION

According to the invention there is provided a railroad ballast plow device adapted for attachment in parallel upright position alongside of a railroad ballast plowing machine; the plow device comprises a longitudinally extending substantially rectangular main plowboard; a first wing means is pivotally connected to a leading edge of the plowboard; a second wing means is pivotally attached to a trailing edge of the plowboard; the first and second wing means each comprises an inner and an outer flap independently rotatable about a substantially vertical hinge line at one of the leading and trailing edges relative to said plowboard; and a means is provided to rotate the flaps. Preferably, a ballast passing gate is located adjacent the bottom edge of the plowboard in the vicinity of the leading and trailing edges thereof.

According to one aspect of the invention there is provided a railroad ballast plowing machine having a side plow assembly comprising a pair of plow devices as aforesaid mounted one on each side of the machine.

DESCRIPTION OF THE DRAWINGS

The following is a description by way of example of one embodiment of the present invention, reference being had to the accompanying drawings in which.

DESCRIPTION OF THE PREFERRED EMBODIMENTS

Figure 1:
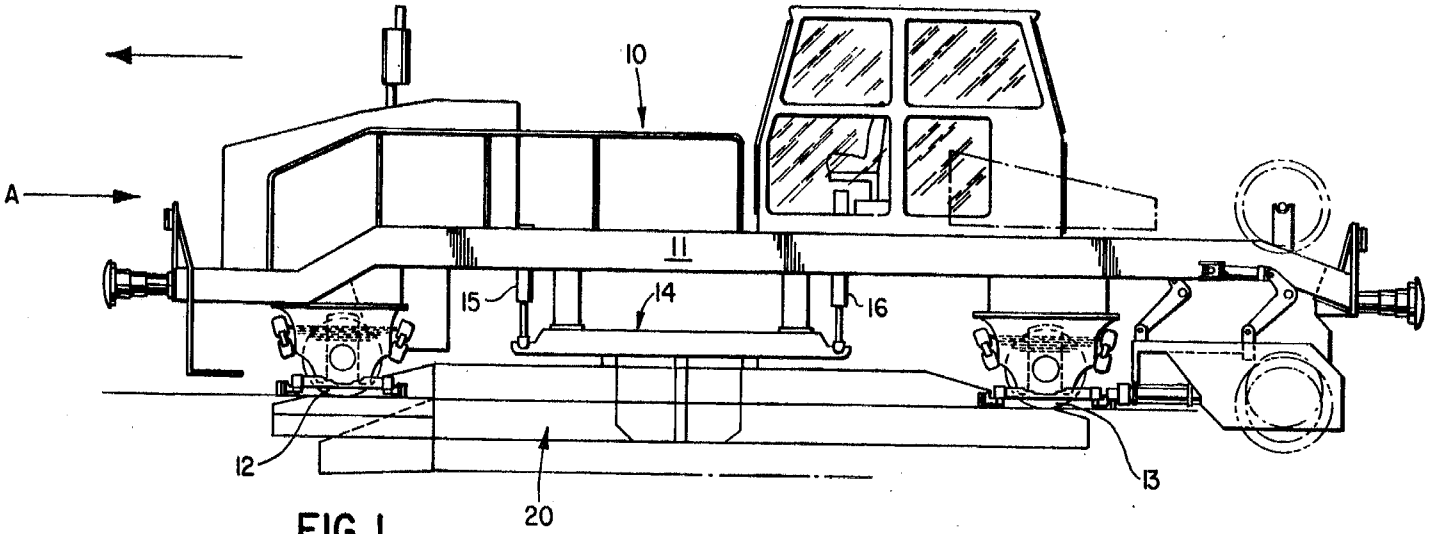
FIG. 1 is a side elevation of a railroad ballast plowing machine incorporating a plow device.

Turning now to the drawings, 10 is a self-propelled ballast plowing machine having a main chassis 11 mounted on rail engaging wheels 12 and 13. The centre plow 14 is mounted underneath the chassis 11 of the vehicle for extension and retraction into and out of engagement with the ballast by means of any suitable arrangement for example hydraulic cylinders 15 and 16. The centre plow 14 may be of any suitable type capable of assuming the V and "across track" configurations shown in FIGS. 4 through 8 and is preferably of the type described in co-pending United States patent application Ser. No. 83,947 filed Oct. 11, 1979, the disclosure of which is incorporated hereinto by reference. A pair of identical side plows 20 and 21 are telescopically and foldably mounted on the machine in any suitable fashion so that they may fold up on either side of the machine as shown in dotted lines in the right-hand side of FIG. 3 where they are carried in carrying members 25 for track travel, and are capable of being lowered into contact with the ballast in a plurality of operative configurations such as shown in the full lines in FIG. 3. On the right-hand side of FIG. 3 the plow device 20 is arranged close to the side of the machine 10 and on the left-hand side of FIG. 3 plow 21 is extended outwardly to engage the ballast at a point farther beyond the tie end. Such mountings of side plows so that they can be telescopically extended and retracted from the side of the machine and folded up for track travel are well known and thus are not described in detail in this specification.

Figure 2:
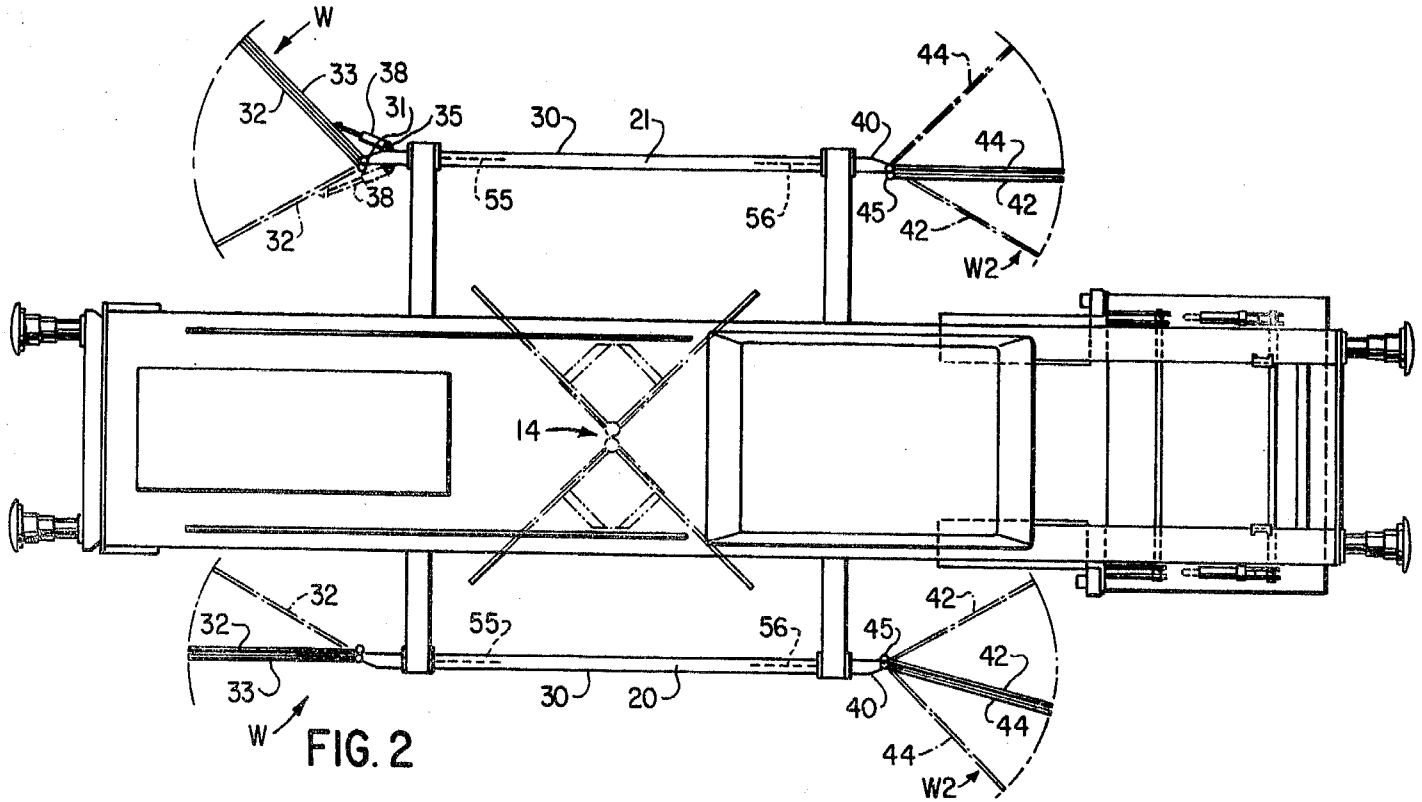
FIG. 2 is a schematic plan view showing a pair of plow devices mounted on the plowing machine.

Turning now to FIG. 2 the side plows 20 and 21 comprise a substantially rectangular main plow board 30 which when in operative position engaging the ballast (either in the close in position as shown for plow 20, or in the somewhat more outwardly extended position as shown for the companion plow 21) assumes an upright position parallel to and along side the railroad ballast plowing machine 10. The plows 20 and 21 carry at their leading edges 31, first wings W. The first wings comprise an inner flap 32 and an outer flap 33 which are hingedly mounted at the leading edges 31 about vertical hinge lines 35. The flaps 32 and 34 are independently rotatable about their hinge lines by any suitable means, for example hydraulic cylinders diagrammatically illustrated at 38. At the trailing edges 40 the plow devices 20 and 21 similarly carry second wing means W2, each of which also comprises an inner flap 42 and an outer flap 44 rotatably mounted about a substantially vertical hinge line 45 independently of each other under the action of hydraulic cylinders or the like. Ballast passing gates 55 and 56 are provided near the bottom of each plow 20 and 21 at their leading and trailing edges and are diagrammatically shown in FIG. 2. These gates 55 and 56 can be opened or closed by any suitable means, either automatically or manually, in order to adjust the plows 20 and 21 to the performance which is desired.

Figure 3:
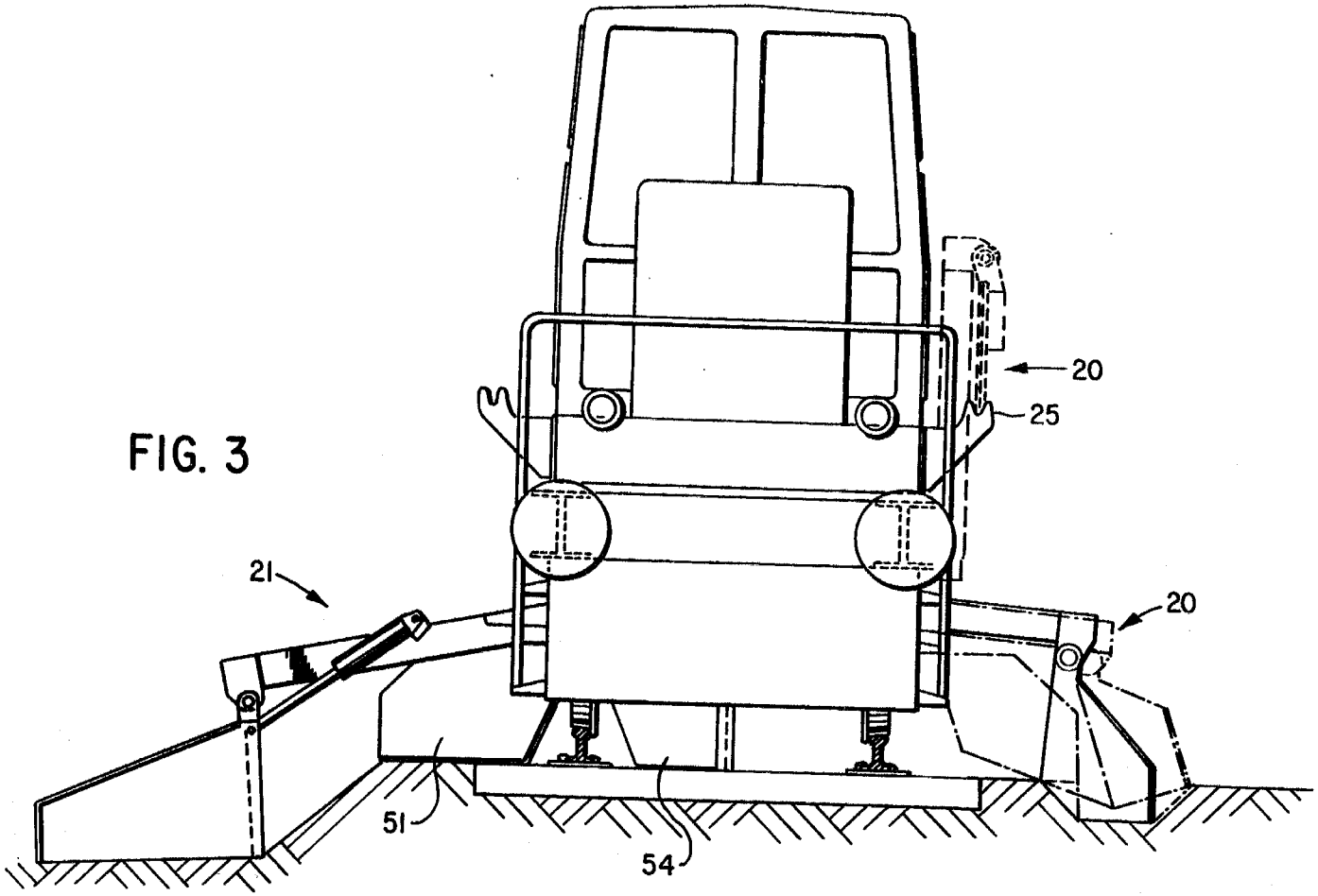
FIG. 3 is an end view looking in the direction of the arrow A in FIG. 1.

In FIG. 3 one blade 51 of the centre plow 14 is shown diagrammatically and has an aperture 54 which clears the rail of the track as in common in the art.

The self propelled machine shown in FIGS. 1 through 3 is capable of moving in either direction so the terms "leading edge" and "trailing edge" as applied to the plow devices 20,21 are to be understood as used in the sense of immediate working direction only and not in an absolute sense.

Figure 4:
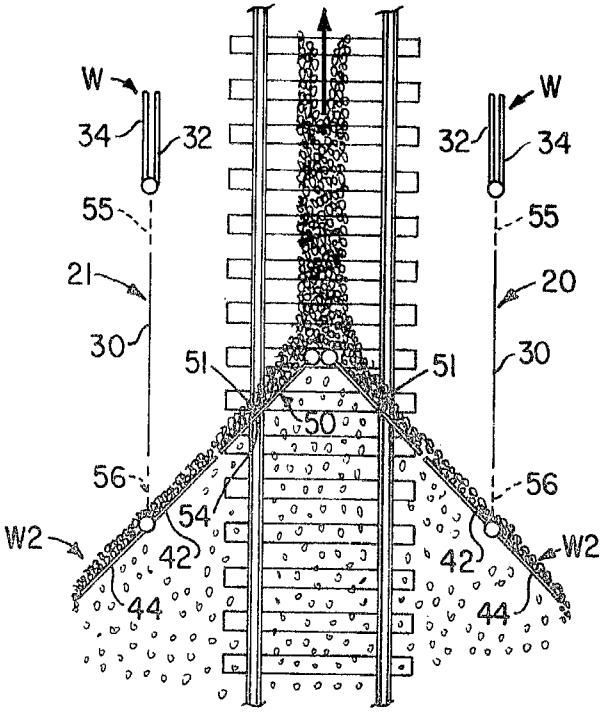

Turning now to FIG. 4, the configuration shown in that which it utilized when it is desired to displace ballast which has been dumped along the centre of the track, outwardly over the track and to the shoulders thereof. In this configuration the inner flaps 32 and the outer flaps 34 of the first wing means are brought together and are aligned with the main plow boards 30 of the plows 20,21 which are themselves positioned equally distant on either side of the machine. At the trailing edges of the plowboards 30 of the plows 20,21 the inner flaps 42 are rotated inwardly and are directed forwardly whereas the outer flaps 44 are rotated outwardly and are directly rearwardly. The wings 51 of the centre plow 50 are arranged in an inverted V formation to produce a plow nose at the centre of the track. As the machine proceeds in the direction of the arrow, the nose of the centre plow 50 engages the ballast and directs it outwardly over either wing 51. Here the ballast is picked up by the inner flaps 42 of the plows 20,21 and passed through the open gates 56 in the plow boards 30, onto the outer flaps 44 and thus is directed to the edges of the track.

Figure 5:
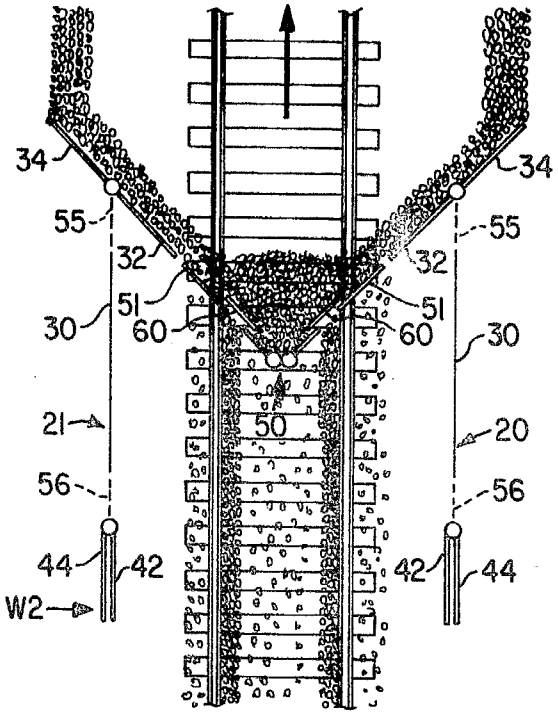
FIGS. 4 through 8 are schematic representations of certain of the uses of the present embodiment of the invention.

Turning now to FIG. 5 in this configuration the ballast has been dumped on either shoulder of the track and it is desired to bring the ballast into the centre of the track and to deposit it in the tamping area adjacent the rails. Here the centre plow 50 has been reversed to form a V-shaped configuration terminating at the centre and gates 60 in the wings 51 of the centre plow 50 are opened. Ballast from the shoulders of the track first encounter the outer flaps 34 and are then directed to the inner flaps 32 of the plows 20 and 21 and from the inner flaps 32 are moved (the direction of the plow being as shown in the arrow) onto the centre plow wings 51 and then through the gates 60 to the tamping area. Here the plow boards 30 of the plows 20,21 extend rearwardly and at equal lateral spacing from the machine and the flaps 42 and 44 of the plow 20,21 are folded into an in-line position.

Figure 6:
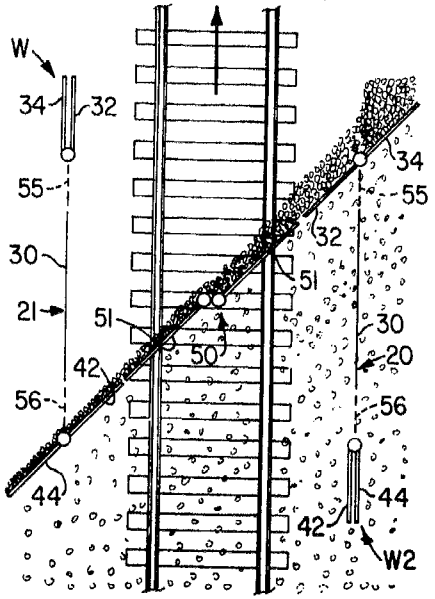

Turning now to FIG. 6, the machine 10 is again proceeding in the direction of the arrow and the plow devices 20 and 21 are again spaced equidistant laterally of the machine. In this mode of operation it is desired to move ballast which is being dumped on the right hand shoulder of the track (as seen in FIG. 6) across the track to the left-hand side of the track. The outer wings 34 of the right-hand plow 20 first engages the ballast on the right-hand shoulder and moves it diagonally across to the inner flap 32 of the plow 20, which in turn transfers it to the forwardly extending wing 51 of the centre plow 50 hence to the rearwardly extending wing 51 of the plow 50 to the inner flap 42 of the plow 21 through the gate 56 of the plow 21 and finally the ballast is moved by the outer flap 44 of the plow 21 to the left shoulder of the track.

Figure 7:
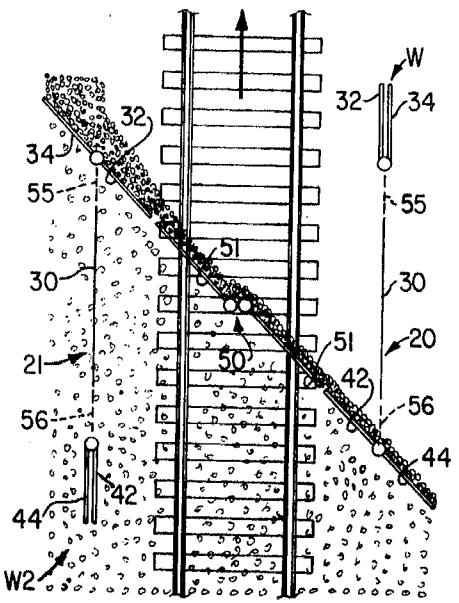

FIG. 7 is the reverse configuration of that shown in FIG. 6 and is utilized where a ballast has been dumped on the left hand shoulder of the track and it is desired to move it to the right-hand shoulder of the track.

Figure 8:
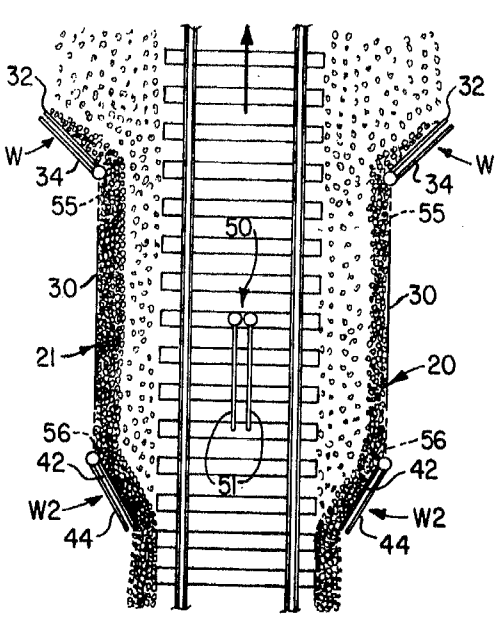

In the configuration shown in FIG. 8 it is desired to bring scattered ballast into a useful area, that is to say, in closer to the track and the leading wings W reach out beyond the track profile and moves the ballast back in close to the track where it can be used or can be reclaimed by means of a back hoe or such device and used elsewhere. In this configuration the flaps 32 and 34 of the leading edge wing W of each of plows 20 and 21 are folded together and are inclined outwardly and the flaps 42 and 44 at the trailing wings W2 of the plows 20,21 are folded together and are folded inwardly. In this configuration of course the gates 55,56 in plows 20,21 are closed. The direction of movement is as shown in the arrow and the centre plows 51 are simply lifted up out of the way.

What I claim as my invention is:

1. A railroad ballast plow device attached in a parallel upright position to one side of a railroad ballast plowing machine, said plow device comprising a longitudinally extending substantially rectangular main plowboard; a first wing means pivotally connected to a leading edge of said plowboard; a second wing means pivotally attached to a trailing edge of said plowboard; and first and second wing means each comprising an inner and an outer flap independently rotatable about a substantially vertical hinge line on one of said leading and trailing edges, relatively to said plowboard; and means to rotate said flaps.

2. A device as claimed in claim 1 in which a ballast passing gate is located adjacent the bottom edge of the plowboard in the vicinity of the leading and trailing edges thereof.

3. A railroad ballast plow machine having a pair of plow devices as claimed in claim 2 mounted thereon one at either side thereof.

* * * * *